US010814203B2

(12) United States Patent
Cooper et al.

(10) Patent No.: US 10,814,203 B2
(45) Date of Patent: Oct. 27, 2020

(54) DEVICES FOR A GOLF PUTTING SYSTEM

(71) Applicant: Totl Holdings LLC, Scottsdale, AZ (US)

(72) Inventors: Ryan Cooper, Scottsdale, AZ (US); Michael Laney, Scottsdale, AZ (US)

(73) Assignee: Totl Holdings LLC, Scottsdale, AZ (US)

( * ) Notice: Subject to any disclaimer, the term of this patent is extended or adjusted under 35 U.S.C. 154(b) by 0 days.

(21) Appl. No.: 16/125,120

(22) Filed: Sep. 7, 2018

(65) Prior Publication Data

US 2020/0129833 A1 Apr. 30, 2020

Related U.S. Application Data

(60) Provisional application No. 62/579,138, filed on Oct. 30, 2017.

(51) Int. Cl.
*A63B 69/36* (2006.01)
*A63B 69/00* (2006.01)

(52) U.S. Cl.
CPC ..... *A63B 69/3661* (2013.01); *A63B 69/0075* (2013.01); *A63B 2069/3682* (2013.01)

(58) Field of Classification Search
USPC ..... 473/157–167, 171, 174–189, 278, 279
See application file for complete search history.

(56) References Cited

U.S. PATENT DOCUMENTS 2,992,005 A * 7/1961 Lockhart ..... A63B 69/3676 473/257
3,934,874 A * 1/1976 Henderson ..... A63B 24/0003 473/265
3,934,882 A * 1/1976 Whittaker ..... A63B 24/0003 473/257
4,805,912 A * 2/1989 Hickman ..... A63B 67/02 473/159
4,953,865 A * 9/1990 Coombs ..... A63B 67/02 473/158
5,129,653 A * 7/1992 Morris ..... A63B 67/02 473/184
5,294,124 A * 3/1994 Florian ..... A63B 24/0003 359/838
5,443,265 A * 8/1995 Wheeler ..... A63B 69/3676 473/257
5,595,543 A * 1/1997 Wolk ..... A63B 67/02 473/162
5,630,719 A * 5/1997 Franklin ..... A63B 67/02 434/252
7,309,290 B2 * 12/2007 Hutchison ..... A63B 67/02 473/180

* cited by examiner

*Primary Examiner* — Nini F Legesse

(74) *Attorney, Agent, or Firm* — HPS Law Group LLC; Clark Proffitt

(57) ABSTRACT

A golf putting system is provided including a platform, a platform holder, a golf mat, an incline, a golf cup, a ball return, a flap, an inlay, and a ball return extension. The platform can either be inserted into the holder, or at a golf mat's aft end. Two or more golf mats can be connected on to each other with a tongue and groove or snapping system allowing the golfers to add and remove golf mat sections to their desired length. A flap can cover seams between sections allowing the golf ball to roll to a golf cup without any obstruction. The platform and holder can move linearly down a golf mats axis allowing the golfer to set any distance from a golf cup.

4 Claims, 10 Drawing Sheets

DEVICES FOR A GOLF PUTTING SYSTEM

CROSS REFERENCE TO RELATED APPLICATIONS

The present application claims the benefit under 35 U.S.C. 119 of U.S. Provisional Patent Application Ser. No. 62/579,138 filed Oct. 30, 2017. The U.S. Provisional Patent Application Ser. No. 62/579,138 is hereby incorporated by reference in its entirety.

TECHNICAL FIELD

The present invention relates to training equipment usable by amateur or professional golf players to check their putting position, lineup, and lag, which can improve the individual's putting quality, and overall golf game.

BACKGROUND

Various types of devices for a golf putting system are known in the art. Golfers are continually looking for ways to improve their putting strokes, and many devices have been developed to help in this endeavor. However, there is not one training device that fulfills the needs of all gofers, and is fully customizable to fit every golfer's needs. Typically, a golfer chooses a putting line to access how the ball should be hit. In choosing the putting line the golfer assesses the slope of the green, the speed of the green, and the distance to the hole to determine how the ball should be struck. Assuming the golfer has chosen the right putting line, the golfer must strike the ball square, or perpendicular to the hemisphere of the ball, with the putter's head, the putter's head must be moving substantially along the putting line for the ball to go to the hole. However, if the ball is not struck along the putting line the ball will miss the hole adding another stroke onto the golfer's score.

It will be appreciated that the putting line and the distance of the put will be determined by the force transferred by the player's swing. In addition, the player's eyes need to be kept directly above and generally behind the ball, and the player's trunk must be flexed between 35 to 55 degrees to help keep the player's club face square and traveling along the putting line.

When golfing it is not legal for a player to draw lines, or make any marks on the green to help aid their putting. Therefore, it is necessary for golfers to practice their alignment, lag, and ability to see the correct putting line to improve their putting skills. Typically, when practicing putting a golfer will aim at the hole at different distances without a training aid. Putting is an activity that requires precise repetitive movements, allowing the golfer to develop correct muscle memory. If the golfer is not striking the golf ball correctly the wrong muscle memory is developed, and the golfer will continue to hit the ball poorly raising the score of the golfer's game.

It would be advantageous to provide a golf putting system that enables the user to practice alignment, lag, and club position resulting in a correct putting line and allowing the golfer to develop the correct muscle memory to consistently hit the golf ball substantially perpendicular with the golf club along the putting line.

SUMMARY

Aspects disclosed herein relates to a golf putting system for a golfer to easily line up, position the golf ball, and obtain the correct muscle memory for obtaining the correct putting line. The golf training system may comprise a platform having a proximal end, a distal end and a cutout, open at the distal end of the platform, and shaped to accommodate a golf ball. A holder may be configured to surround at least a portion of the outside perimeter of the platform and a groove in inside edge of the holder accepts the platform to secure the platform in the holder. At least one arm extends from the holder and secures the holder to a golf mat. At least a portion of the platform may be reflective. In a particular embodiment, the cutout is substantially parabolic and the terminal radius of the parabola is sized to be substantially the same radius as a golf ball to provide an intuitive place to position the golf ball when using the golf training system.

The platform may comprise at least one alignment guide to give the user a focal point when hitting the golf ball with the golf training system. The arm of the platform may have a first arm extending from a first side of the platform and a second arm extending from an opposing second side of the platform and an extension extending perpendicularly from each arm that is spring biased to engage an edge of the golf mat to secure the holder to the golf mat. The arm may have a hook on the end of the arm to more easily engage the golf mat. The length of the arm may be adjustable to accommodate a variety of different golf mats. The holder may sit substantially flat on the surface of the golf mat, or may have an adjustable height.

An additional advantage of the system according to the present invention is that the user can adjust the length for each putt by moving a putting training device along a putting surface's linear axis. The golf mat may be made up of a plurality of golf mat sections that can be selectively connected to adjust the length of the golf mat. The golf mat sections may comprise at least one sight line to allow the user to align the golf stroke. In one embodiment, at least one of the sections has a platform integrated into a surface of the mat section. The mat may be placed platform surface up when the user wishes to use the platform or may alternatively be place platform surface down to use the section as a normal section of the golf mat. The sections of golf mat and the integral platform may be essentially flexible for convenient transport and/or storage of the golf mat section.

The golf training system may also comprise an incline and a golf cup situated in the incline to vary the difficulty of golf shots available to practice with the golf training system. A ball return allows the ball to be rolled back to the user when the user makes the ball into the golf cup. In a particular embodiment, the ball return may be removable.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

DETAILED DESCRIPTION

The embodiments of the invention described herein are not intended to be exhaustive or to limit the invention to precise forms disclosed. Rather, the embodiments selected for description have been chosen to enable one skilled in the art to practice the invention.

Figure 1:
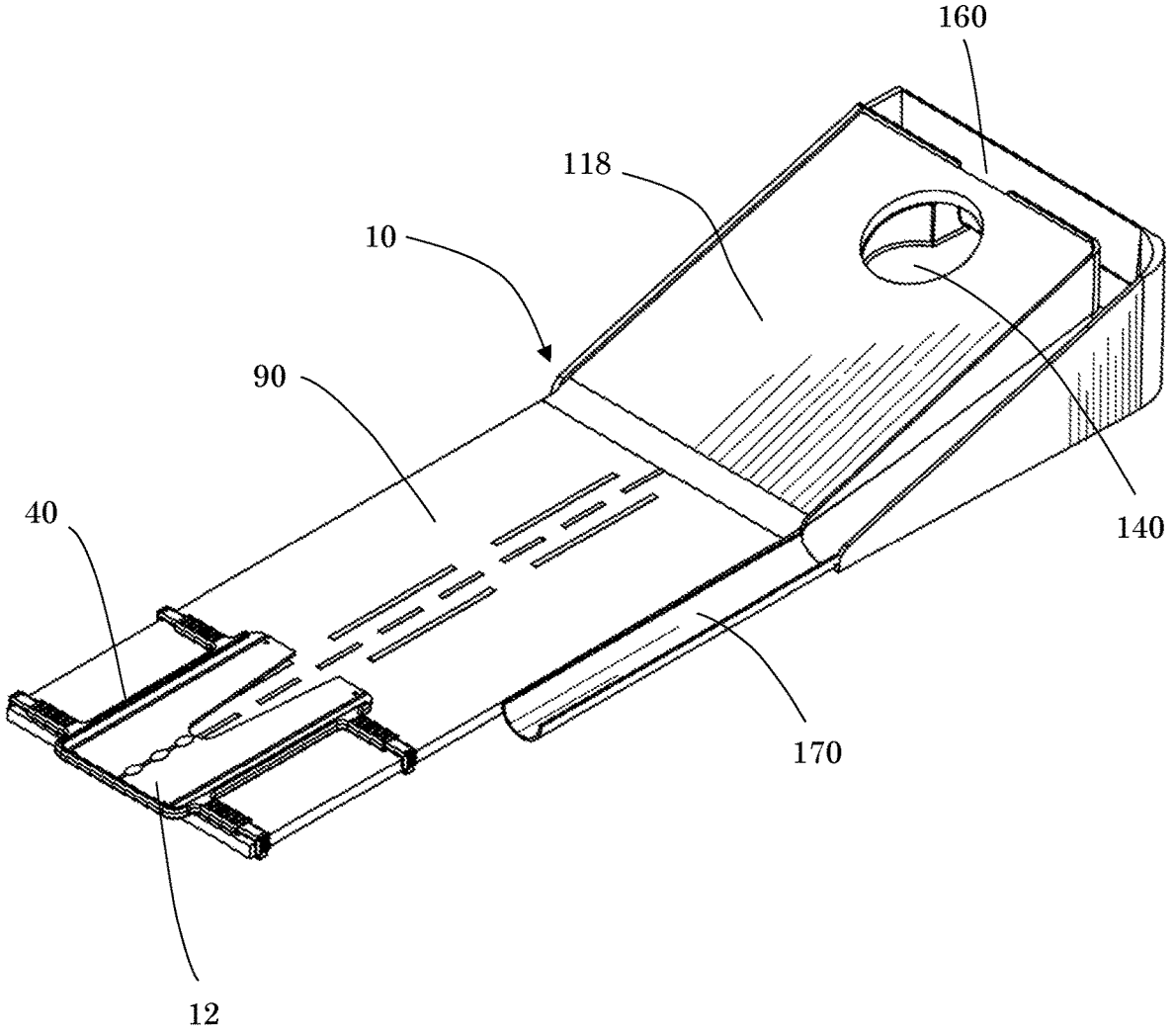
FIG. 1 shows an isometric view of a golf putting system in accordance to one, or more embodiments.

Referring initially to FIG. 1, a golf putting system 10 is shown. In a preferred embodiment, the golf putting system 10 can be designed to be easily compacted and stored when not in use. The golf putting system 10 can comprise a platform 12 that may be removably inserted into a platform holder 40, a golf mat 90, an incline 118, a golf cup 140, a ball return 160, and a ball return extension 170. The platform 12 can be removed from the golf putting system and placed on a golf green or removed for easy storage. The platform 12 and platform holder 40 can be removably placed onto a golf mat 90, and may slide up and down the golf mat's linear axis giving the golfer the ability to practice putting at different distances to the golf cup 140.

Figure 2:
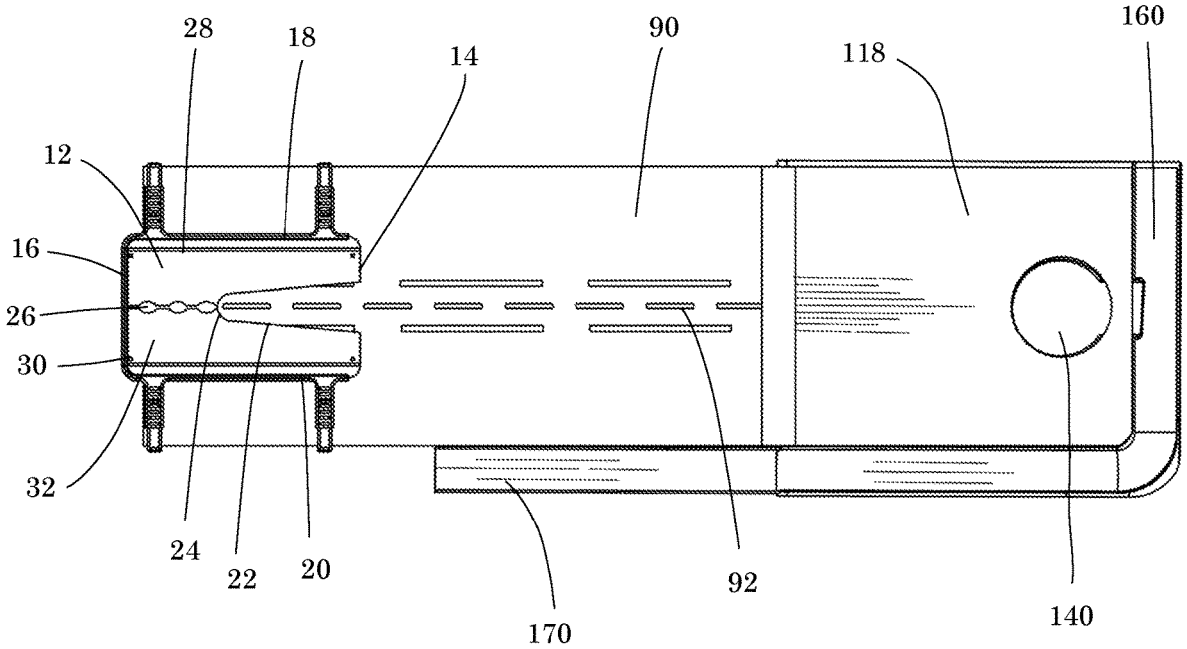
FIG. 2 shows a top view of a golf putting system in accordance to one, or more embodiments.

Referring to FIG. 2 in some embodiments, a platform 12 can be substantially rectangular having a distal end 14, and an opposing proximal end 16, and a first side 18 and an opposing second side 20, and a top 32 and a bottom (not shown) having a thickness 19. The putting training device 12 can have a thickness 19 of, for example, between 0.0625 inches and 0.250 inches, more preferably a thickness of between 0.09375 inches and 0.1875 inches, and still more preferably of approximately 0.125 inches. The platform 12 can comprise a cutout 22 opening on the distal end 14, and tapering to terminus 24 towards the proximal end 16 that ends substantially at the center line of the platform. In a preferred embodiment, the shape of the cutout 22 may be essentially parabolic and the terminus 24 is a terminal radius 25. The radius 25 can be substantially the width of a golf ball. In certain embodiments, the cutout 22 can be a substantially columnar slot having a width substantially the width of a golf ball forming a terminal radius 25 on the platform 12 and being open at the distal end 14 of the platform 12. In certain embodiments, the cutout 22 can be omitted, and its shape can be painted or etched into a putting training device's top surface 32. In alternative embodiments, the cutout 22 may not extend through the thickness 19 of the platform 12 and may form a depression in the platform 12.

The platform 12 can be substantially rectangular, square, hexagonal, triangular, or the like in shape and/or an end 14, 16 or a side 18, 20 can have be u-shaped, v-shaped, semi-circularly shaped, or the like.

In some embodiments, the platform 12 can have one or more alignment guides 26 that can be oval or circular in shape, positioned on its tops surface substantially spaced apart from terminus 24 of the cutout 22 towards the proximal end 16 of the platform 12, which can be used to correctly position the user's head and body over the golf ball by giving the user a reference to look directly at when about to strike the golf ball. In certain embodiments, the alignment guides 26 can be circular, oval, square, rectangular, triangular, diamond, or the like in shape. In particular embodiments, multiple alignment guides 26 are equally spaced from each other to form a line from the terminus 24 of the cutout 22 to the proximal end 16 of the platform. The gap between the multiple alignment guides 26 can be between 0.0625 inches and 0.250 inches, more preferably between 0.09375 inches and 0.1875 inches, and still more preferably approximately 0.125 inches. The alignment guides 26 can be placed or etched into or on a top surface of the platform 12, or it can be indented into a top surface of the platform. In certain embodiments, there can be one, two three, four, five, or the like alignment guides 26 placed along the linear axis of the platform 12. In still other embodiments, the alignment guides 26 can be on a bottom surface of the platform, or can be one or more thru holes.

The platform 12 can have one or more lines 28 that can be positioned towards a first side 18, and an opposing second side 20, and extending the length of the platform 12 from the distal end 14, to the proximal end 16. The lines 28 can vary in width such as, for example, between 0.0625 inches and 0.250 inches, more preferably a width of between 0.09375 inches and 0.1875 inches, and still more preferably a width of approximately 0.125 inches or the like. In certain embodiments, there can be one line, two lines, three lines, four lines, or the like spaced linearly apart and running substantially parallel to the sides 18, 20. In another embodiment, the lines 28 can be dashed lines extending from the distal end 14 to the proximal end 16.

The platform 12 can be made from a lightweight, generally rigid material, such as, for example, plastics including acrylic, acrylonitrile butadiene styrene ("ABS"), polypropylene, polyamide, polyethylene, metals, or the like. Although a putter head is not intended to strike or come into contact with the platform 12 during the use thereof, the materials for the platform 12 should be selected to be sufficiently durable to withstand impact in case a golfer inadvertently strikes the platform 12 while training.

In some embodiments, the platform 12 can be made of, or can have a reflective surface attached such as, for example, a mirror, an acrylic mirror, glass, reflective tape, glossy metal, crystal, reflective film, reflective Mylar film, aluminum, reflective spray, or the like. A reflective surface can cover a top 32, and/or bottom (not shown) of the platform 12 from the distal end 14, to the proximal end 16, and from a first side 18 to an opposing second side 20. In certain embodiments, a reflective surface, and the platform 12 can be integrally made from one piece, and the platform can be the reflective surface. In another embodiment, the platform 12, can be made of a generally flexible material, and can easily roll up or fold up with a putting surface 28 such as, for example, flexible reflective mirror, acrylic mirror, thin sheet of aluminum, crystal clear flexible mirror, reflective mylar, or the like. In certain embodiments, the platform 12 can be flexible, and can roll up for easy storage, and shipping, or it can be solid and can easily fit into a shipping container or box.

The platform 12 can have one or more holes 30 placed substantially near the proximal end 16, and substantially near the distal end 14. A hole 30 can be sized to fit a standard golf tee, or can be sized at such as, for example, between 0.1 inches and 4 inches, more preferably a size of between 0.08375 inches and 2 inches, and still more preferably of approximately 0.125 inches.

Figure 3:
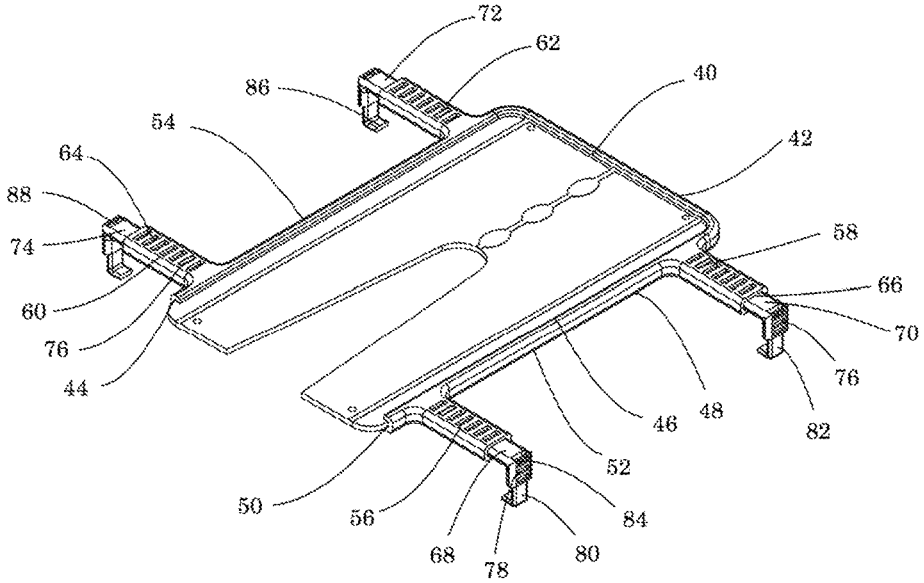
FIG. 3 shows an isometric view of a golf putting system omitting a golf mat, a wedge, and ball return in accordance to one, or more embodiments.

Referring to FIG. 3, a holder 40 can be substantially u-shaped with a closed first end 42, and an open second end 44 to allow for the golf ball to roll freely past the holder's second end. The holder 40 can further comprise a first side 52, and an opposing second side 54. In certain embodiments, a holder 40 can be square, rectangular, triangular, circular, or the like in shape with its perimeter either being partially surrounding, or fully surrounding the platform's 12 perimeter. In some embodiments, the holder 40 can have a top and a bottom, an inner edge 46, and an outer edge 48 with a groove 50 on its inner edge. The groove 50 can be u-shaped, v-shaped, semi-circular shaped, or the like. The groove 50 can substantially follow the inner edge's 46 path, and can mate with the platform's 12 perimeter having a similar shape to mate with and at partially enclose the platform 12. The platform 12 can be easily removed from the holder 40, allowing the user to insert, or remove the platform, and take it to other training areas such as a golf course. The groove 50 can substantially the platform's 12 distal end 14, and proximal end 16, and first a side 18 and opposing second side 20 outer perimeter's shape. The platform 12 can be inserted, slid, or placed into the holder 40. The holder 40 can substantially support the platform 12 on two or more sides.

In embodiments, the holder 40 can sit substantially flat on a golf mat's 90 surface. A holder 40 can have two or more arms 56, 58, 60, 62 that extend perpendicular from its first side 52 and its second side 54. In an exemplary embodiment, a holder 40 can have a first arm 56, and a second arm 58 extending perpendicular from its first side, and a third arm 60, and a fourth arm 62 extending perpendicular from its second side 54. The arms 56, 58, 60, 62 can extend gradually from a putting training device holder's 40 first side 52 and second side 54 forming a radius, chamfer, a 90-degree angle, or the like at its intersection. The arms 56, 58, 60, 62 can have beveled, straight, or bullnose edges or the like creating a smooth transition from its surfaces. In certain embodiments, the arms 56, 58, 60, 62 can be rectangular, circular, square, or the like.

In embodiments, the arms 56, 58, 60, 62 can have a plurality of adjustment holes 64 evenly spaced and positioned on its top, and/or bottom surface. A plurality of adjustment holes 64 can be rectangular, square, circular, or the like. The arms 56, 58, 60, 62 can have a slot 66, hole, or it can be hollow having an inner and outer shell from its end extending towards the holder's 40 first side 52 and second side 54. The slot 66 can perpendicularly intersect a plurality of adjustment holes 64 and can be circular, square, rectangular, hexagonal, or the like. In certain embodiments, a plurality of adjustment holes 64 can be located on the arm's 56, 58, 60, 62 side surface. In certain embodiments, the arms 56, 58, 60, 62 can be a solid piece instead of having a slot 66.

In some embodiments, the holder 40 can have two or more adjustment connection sections 68, 70, 72, and 74 protruding and removably connected to the arms 56, 58, 60, 62. An adjustment connection section 68, 70, 72, and 74 can have a male connection, where it can be inserted and arm's 56, 58, 60, 62 slot 66, and can slide inside of the slot 66 allowing the user to adjust the length of an adjustment connection section 68, 70, 72, 74. An adjustment connection section's 68, 70, 72, and 74 male connection can have one or more prongs 76 extending perpendicularly from its top surface. A prong 76 can be placed at an adjustment connection section's 68, 70, 72, and 74 male connection end or substantially close to its end. A prong 76 can snap into, and can substantially fit into one of the plurality of adjustment holes 64 allowing the user to adjust to one or more widths and/or lengths, so that a user can place and adjust to various golf mat sizes. A prong 76 can be rectangular, circular, square, or the like, and can be pressed down into an adjustment connection section's 68, 70, 72, and 74 male section allowing the user to manual adjust the length of each adjustment connection section. In another embodiment, an adjustment connection sections 68, 70, 72, and 74 and the arms 56, 58, 60, 62 can be one piece and set at a known golf mat's 90 width can be for example, between 6 inches and 18 inches, more preferably a size of between 8 inches and 14 inches, and still more preferably of approximately 12 inches. An adjustment connection sections 68, 70, 72, and 74 and the arms 56, 58, 60, 62 can be one piece and set at a known golf mat's 90 width to such as, for example, between 6 inches and 18 inches, more preferably a size of between 8 inches and 14 inches, and still more preferably of approximately 12 inches.

In some embodiments, an adjustment connection section 68, 70, 72, and 74 can have a height adjustment 76 extending perpendicularly from an adjustment connection section's 68, 70, 72, and 74 male connection. The height adjustment 76 can have an opening 88 extending from its bottom surface to its top surface. The height adjustment's opening 88 can be rectangular, circular, square, or the like in shape. The height adjustment 76 can have a plurality of holes 78 on its outer, and/or inner surface. In certain embodiments, an opening 88 can extend from its bottom surface and not break through its top surface. A plurality of holes 78 can be rectangular, square, circular, oval, or the like, and can be evenly or unevenly spaced along the height adjustment linear axis.

In some embodiments, the holder 40 can further comprise one or more hooks 80, 82. A hook 80 can have be substantially L-shape, and can have a male connection 84 having a length, and a golf mat connection 86 extending perpendicular to a male connection. A male connection 84 can have a prong that extends perpendicular to its front or back surface, and can be pressed into a male connection's body, and then can be snapped into a height adjustment's 76 plurality of holes 78 allowing the user to adjust to one or more heights, so that a user can place the device and adjust to various golf mat thicknesses. A hook 80 with a male connection 84 can adjust to for example, between 0.125 inches and 4 inches, more preferably a size of between 0.09375 and 1.75 inches, and still more preferably of approximately 1 inches. A golf mat connection 86 can extend perpendicularly from a male connection's 84 bottom edge and form into for example, a point, a blunt edge, a radius edge, a chamfered edge, or the like. A golf mat connection 86 can extend for example, between 0.125 inches and 2 inches, more preferably a size of between 0.0875 inches and 1.125 inches, and still more preferably of approximately 0.5 inches.

Figure 4:
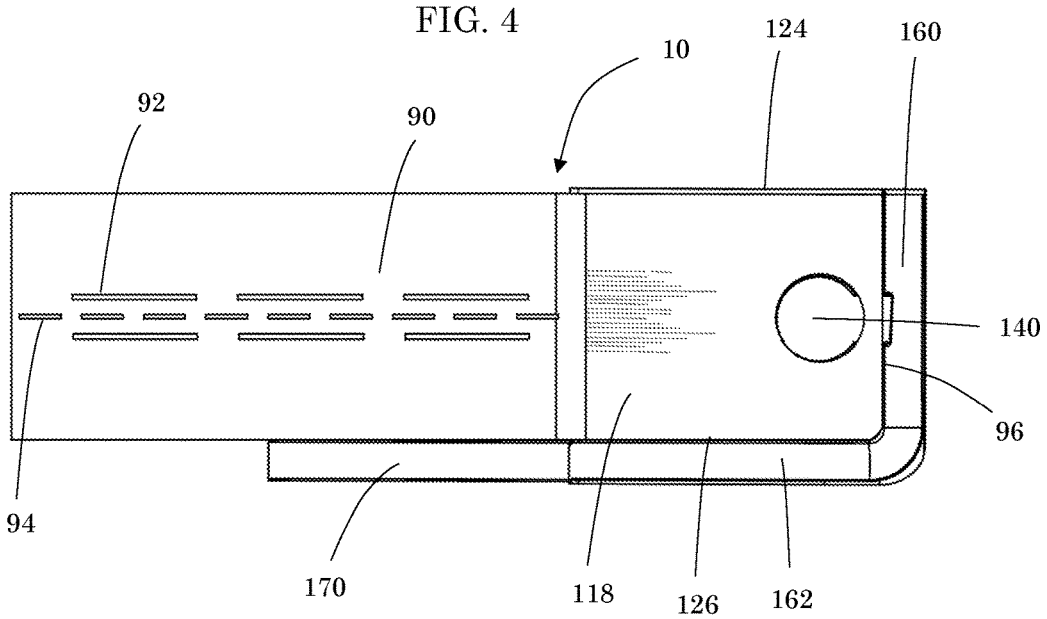
FIG. 4 shows a top view of a golf putting system omitting a putting training device, a putting training device holder in accordance to one, or more embodiments.
Figure 5:
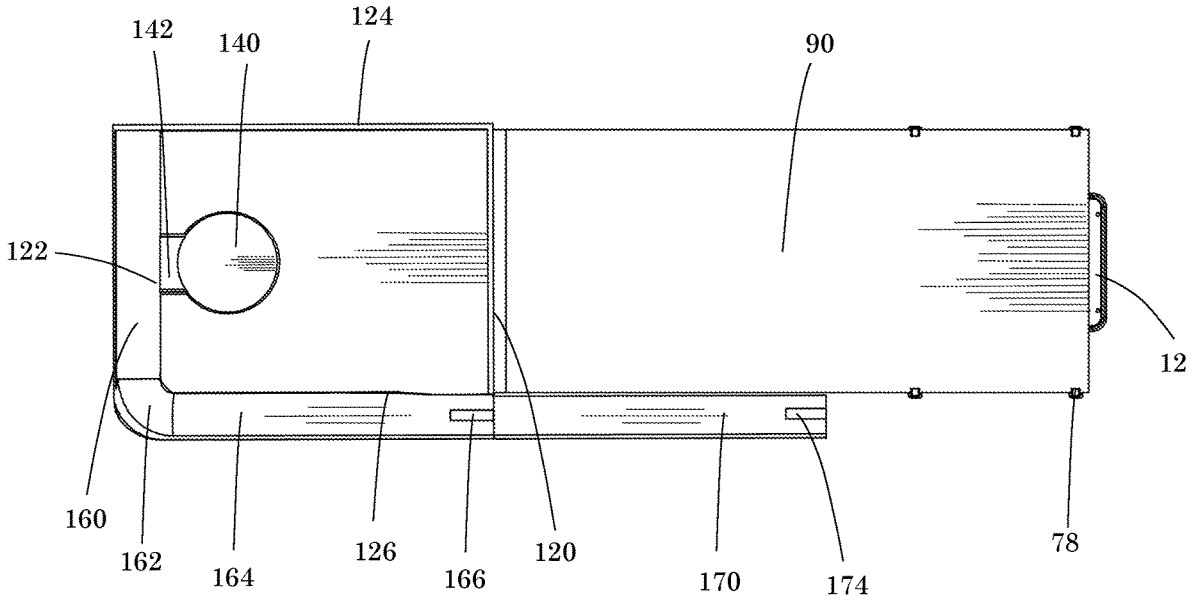
FIG. 5 shows a bottom view of a golf putting system in accordance to one, or more embodiments.
Figure 6:
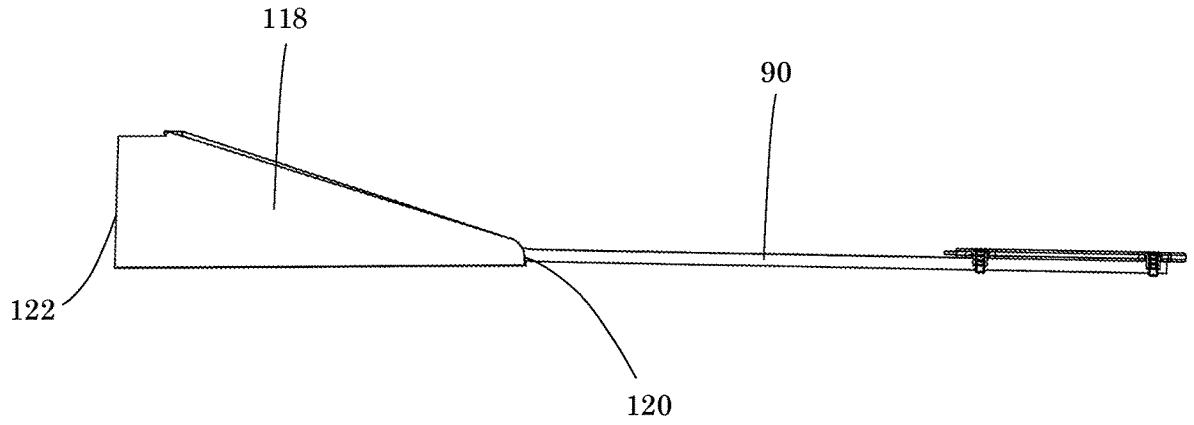
FIG. 6 shows side view of a golf putting system in accordance to one, or more embodiments.

In another embodiment a hook 80, and an adjustment connection section 68, 70, 72, and 74 can be one piece and permanently set at a known golf putting mat's thickness for example, between 0.125 inches and 2 inches, more preferably a size of between 0.0875 inches and 0.125 inches, and still more preferably of approximately 0.5 inches. A hook 80, and an adjustment connection section 68, 70, 72, and 74 can be one piece and permanently set at a known golf mat's 90 thickness for example, between 0.125 inches and 2 inches, more preferably a size of between 0.0875 inches and 0.125 inches, and still more preferably of approximately 0.5 inches Referring to FIGS. 4, 5, and 6 a side view of a golf putting system shown generally at 10 with a holder 40, and a platform 12 being omitted, a top view, and a bottom view. A golf putting system 10 can comprise an incline 118 which can be tapered downwards towards a proximal end 120 and can be located under a golf mat's 90 distal end 122, and it can have a first side 124, and a second side 126. The incline 118 may be wedge or mound shaped or have any other shape to help a golfer practice varied putting lines. The incline 118 can comprise of one or more sections, or can contain a hinging section (not shown) for folding, and thereby allowing compact storage. The incline 118 can further comprise a flat surface which can be attached to and can come into contact with a golf mat 90. A golf mat 90 can be attached to the incline 118 by, for example, Velcro, tabs, bolts, screws, pins and slots, or the like. A golf mat 90 can be removed from the incline 118 for easy storage, and to easily fit into a shipping box. The incline 118 can be made of a suitable structural material such as, for example, plastic, metal, wood, or the like. In a preferred embodiment, the incline body can be made of a plastic moldable material. the incline 118 bottom surface can be a cavity and can be formed such that it communicates underneath with a flat surface 126 which extends from its proximal end 120 to its distal end 122.

In some embodiments, a golf cup 140 can be a cavity having a dimensions of a regulation golf cup defined by a cup opening and superimposed over a cup cavity. the golf cup 140 can be a part of, or can be included in the incline 118. The golf cup 140 can be located substantially centered between the incline's 118 first side 124, and second side 126. The golf cup 140 can have a slight angle allowing a golf ball to roll towards the distal end 122 of the incline 118 and into a ball return 160. The primary object for the golfer practicing is to putt the golf ball from the proximal end towards the distal end of a golf putting surface and into a golf cup 140 located at the distal end.

An accurately aimed golf ball can drop into the golf cup 140, and gradually roll towards a ball return 160. The ball return 160 can have an angle that is just slightly past horizontal where horizontal is 0 degrees. Horizontal relative to the incline 118 is perpendicular to the incline's flat surface 126. The ball return 160 can be angled at for example, between 5 degrees and 20 degrees, more preferably a size of between 10 degrees and 18 degrees, and still more preferably of approximately 15 degrees.

A ball return 160 can be removable connected to or permanently connected to the incline 118 and may be comprised of a single piece or multiple pieces, and may include a 90-degree ball return 162, and a ball return accelerator 164. The 90-degree ball return 162, and ball return accelerator 164 can continue the ball return's 160 angle and can be coupled to the incline's proximal end 120, and a surface upon which the incline 118 is sitting.

In certain embodiments, the ball return accelerator 164 can start from a 90-degree ball return 162, and end at a proximal end of the incline 118. The ball return accelerator 164 can have a top surface and a bottom surface, and can be semi-circular in shape, and in certain embodiments it can be rectangular, square, hexagonal, or the like. On the ball return accelerator's 164 bottom surface, near the incline 118 proximal end 120, an attachment sleeve 166 may be coupled as a ball return extension. The attachment sleeve 166 can be a flat rectangular, square, or circular sleeve that can removably attach a ball return extension 170 to another ball return extension creating a chain and/or the attachment sleeve 166 can removably attach other components to the ball return accelerator. A ball return extension 170 can be semi-circular in shape, and in certain embodiments it can be rectangular, square, hexagonal, or the like. A ball return extension 170 can have a second attachment sleeve 174 which can be a flat rectangular, square, or circular sleeve that can removably attach to another ball return extension 170.

Figure 7:
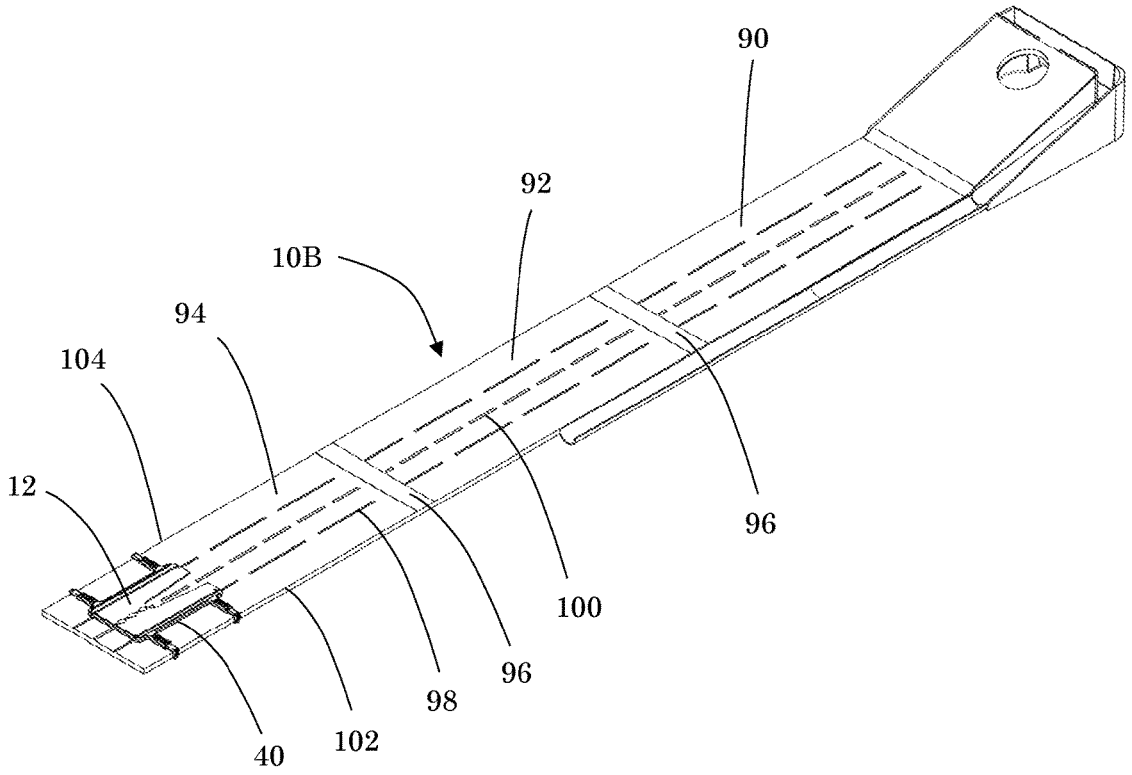
FIG. 7 shows isometric view of a golf putting system with golf mat extensions in accordance to one, or more embodiments.
Figure 17:
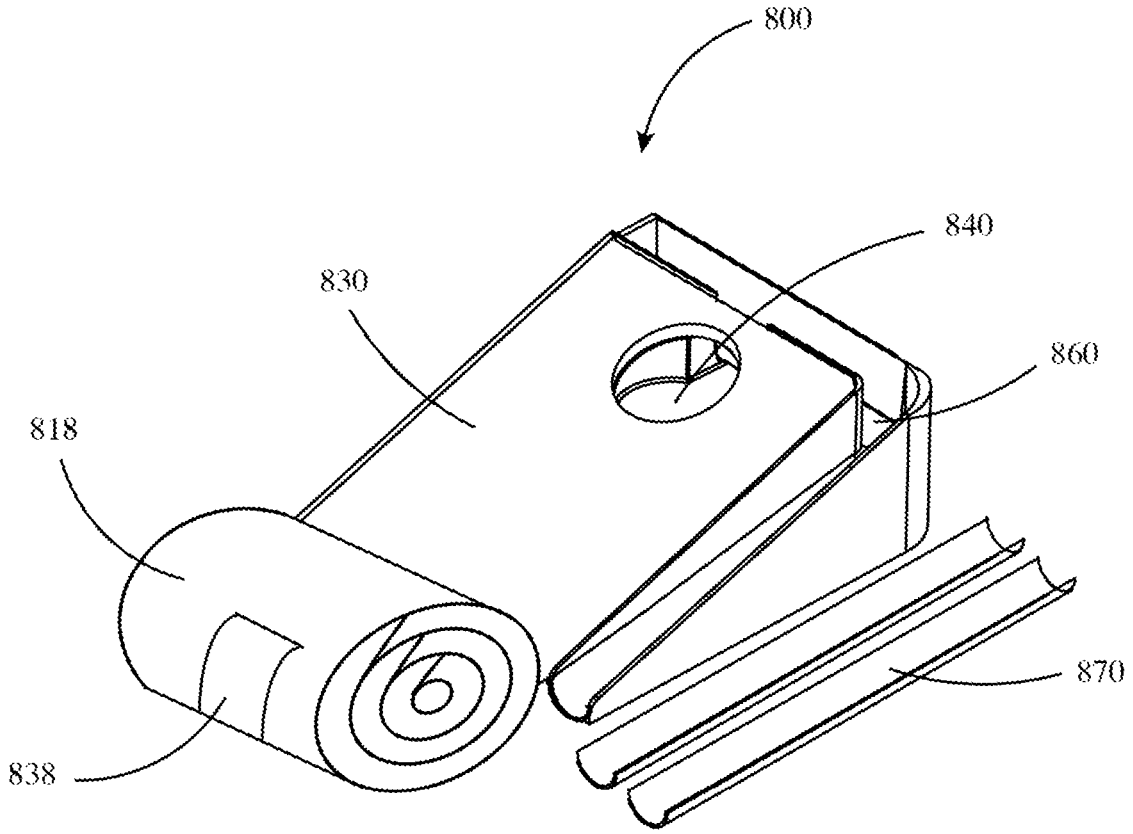
FIG. 17 shows an isometric view of a golf putting system rolled and stored in accordance to one in accordance to one or more embodiments.

Referring to FIG. 7, a holder 40 and a platform 12 can slide axially down a golf mat 90 allowing the user to add on extra golf mat sections, so that the user can practice at different lengths. The golf mat 90 can be flexible and can be rolled or folded for compact storage as shown in FIG. 17. A golf mat 90 can provide resistance that is similar to natural grass when the ball rolls along it surface. The golf mat 90 can be divided into one or more sections to allow easy storage, or to allow the user to add on one or more golf mat sections 92, 94. The golf mat 90 can be, for example, at least 1 foot long, at least 2 foot long, at least 3 foot long, at least 4 foot long, at least 5 foot long, at least 6 foot long, at least 7 foot long, at least 8 foot long, at least 9 foot long, or the like. A golf mat 90 can be, for example, at most 1 foot long, at most 2 foot long, at most 3 foot long, at most 4 foot long, at most 5 foot long, at most 6 foot long, at most 7 foot long, at most 8 foot long, at most 9 foot long, or the like.

In some embodiments, The golf mat 90 can have additional golf mat sections 92, 94 added onto to it to give it added length and the golf mat sections 92, 94 can have a seamless transition between each golf mat section by a golf mat connection 96 which can be connect each golf mat by Velcro, snaps, hinges, or the like. The golf mat connection 96 removably attaches each golf mat section 90, 92, 94 to each other. The golf mat connection 96 can lay into a golf mat section 90, 92, 94 so that each golf mat connection, and golf mat section lays at the same height and be a seamless transition from one section to another section allowing the golfer's ball to roll smoothly over each golf mat section. The golf mat connection 96 can be removably attached or permanently attached to a golf mat 90, and a golf mat section 92, 94 on its leading edge, and can be removably attached to each preceding golf mat or golf mat section on its trailing edge. The golf mat connection 96 can lay substantially flat between a golf mat 90, a golf mat section 92, and between each golf mat section 94. The golf mat section 92, 94 can be for example, between 1 foot and 10 foot, more preferably a size of between 4 feet and 8 feet, and still more preferably of approximately 3 feet. In certain embodiments, the golf mat 90 can be connected to the golf mat section 92, which can be connected to one or more golf mat sections such as, for example, one golf mat section, two golf mat sections, three golf mat sections, four golf mat sections, or the like.

In some embodiments, a golf mat connection 96 can be a folding flap, seamless flap, or the like allowing the golf ball to roll over each golf mat section without any obstruction, and can be removed from each other for easy removal and storage. The golf mat connection 96 can extend the entire width of a golf mat 90, and golf mat sections 92, 94. The golf mat connection 96 can be hinged connecting to a golf mat section's 92, 94 forward end, and in some embodiments to a golf mat section's aft end. The golf mat section 92, 94, and a golf mat 90 can have an indent, a notch, or groove, that can be on its aft or forward end. The golf mat connection 96 can sit flush and substantially flat against a connecting a golf mat 90, and a golf mat section 92, 94.

Golf mat section 92, 94, and golf mat 90 can each have a plurality of lines 100 that can be evenly spaced and positioned to allow adjacent sections to align. In a particular embodiment, the line 100 is in the center of the golf mat section 92, 94 and golf mat. The line 100 can vary in width for example, between 0.0625 inches and 0.250 inches, more preferably a width of between 0.09375 inches and 0.1875 inches, and still more preferably a width of approximately 0.125 inches or the like. In certain embodiments, a plurality of center lines 100 can be unevenly spaced apart substantially centered on a golf mat 90, and golf mat connection 92, 94.

The golf mat 90, and/or golf mat sections 92, 94 can have one or more sight lines 98 The sight lines 98 can be spaced apart from each other by about the width of a golf ball. In a particular embodiment, a plurality of sight lines 98 can be evenly spaced linearly down a golf mat 90, and a golf mat section 92, 94. Alternatively, the plurality of sight lines 98 can be unevenly spaced linearly down a golf mat 90, and a golf mat section 92, 94. The plurality of sight lines 98 can vary in width for example, between 0.0625 inches and 0.250 inches, more preferably a width of between 0.09375 inches and 0.1875 inches, and still more preferably a width of approximately 0.125 inches. A plurality of sight lines 98 can vary in length for example, between 0.0625 inches and 0.250 inches, more preferably a width of between 0.09375 inches and 0.1875 inches, and still more preferably a width of approximately 0.125 inches.

Figure 8:
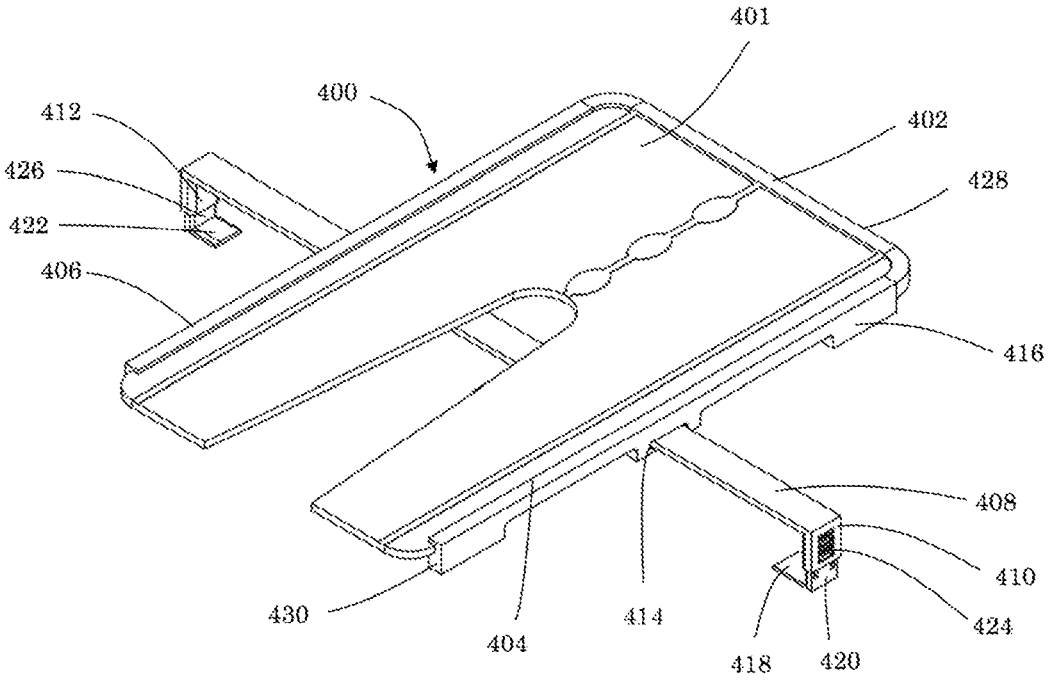
FIG. 8 shows an isometric view of alternative embodiment of a golf putting system omitting a golf mat, wedge, and ball return in accordance to one in accordance to one, or more embodiments.

Referring to FIG. 8 an isometric view of another embodiment of a golf putting system shown generally at 400. In embodiments, a holder 402 can have a first end 428 and an opposing second end 430, and a first side 404 and an opposing second side 406, and a bottom surface (not shown), and a top surface. A first side 404, and an opposing second side 406 can have a slide connector 414 extending vertically from a putting training device holder's bottom surface. A slide connection 414 can be can be removably attached, or permanently attached to a bottom surface of a putting training device holder's first side 404, and opposing second side 406. A holder 402 and slide connection 414 can be made of one or more molds. In certain embodiments, a slide connection 414 can be made of such as, for example, plastics, aluminum, stainless steel, carbon steel, or the like, and then permanently attached to a bottom surface of a holder 402. In other embodiments, a slide connection 414 can be attached by, for example, bolts, screws, clamps, rivets, or the like. A slide connection 414 can have a thru hole that can be rectangular, square, circular, or the like to allow the sliding bar 408 to smoothly slide back and forth for the golfer to adjust the position of the golf training device on the golf mat.

In another embodiment, a sliding bar 408 can extend perpendicular from a putting training device holder's 402 first side 404, and an opposing second side 406, and it can sit substantially on top of a sliding bar. A sliding bar 408 can have a top surface, and a bottom surface with a substantially constant thickness. A sliding bar 408 thickness can be such as, for example, between 0.0625 inches and 0.250 inches, more preferably a width of between 0.09375 inches and 0.3875 inches, and still more preferably a width of approximately 0.25 inches or the like. A sliding bar 408 can be rectangular, circular, square, or the like and can match the slide connection 414 shape. In certain embodiments, a sliding bar 408 can have an adjustable section where the sliding bar can adjust to the width of a golf putting mat, and lock into place. In embodiments, a sliding bar 408 can have a first height adjustment 410, and an opposing second height adjustment 412 that can extend perpendicular to a sliding bar's bottom surface. A height adjustment 410, 412 can have a plurality of holes 424 extending vertically down the height adjustments surface. A plurality of holes 424 can be rectangular, square, circular or the like, and can be evenly or unevenly spaced.

In another embodiment, a male connection 420, 426 can be removable attached to a first and a second height adjustment 410, 412. A male connection 420, 426 can have a hook 418, 422 extending perpendicularly from a first and second height adjustment 410, 412, and can be substantially L-shape. A male connection 420, 426 can have a prong (not shown) that extends perpendicularly to its front or back surface, and can be pressed into a male connection's body, and then can be snapped into a height adjustment's 410, 412 plurality of holes 424 allowing the user to adjust to one or more heights, so that a user can place the device and adjust to various golf mat thicknesses. A hook 418, 422 with a male connection 420, 426 can adjust to for example, between 0.0625 inches and 0.50 inches, more preferably a width of between 0.09375 inches and 0.3875 inches, and still more preferably a width of approximately 0.25 inches or the like. A hook 418, 422 can extend perpendicularly from a male connection's 420, 426 bottom edge and form into such as, for example, a point, a blunt edge, a radius edge, a chamfered edge, or the like. In another embodiment, a hook 418, 422 can extend across and connect to each other.

Figure 9:
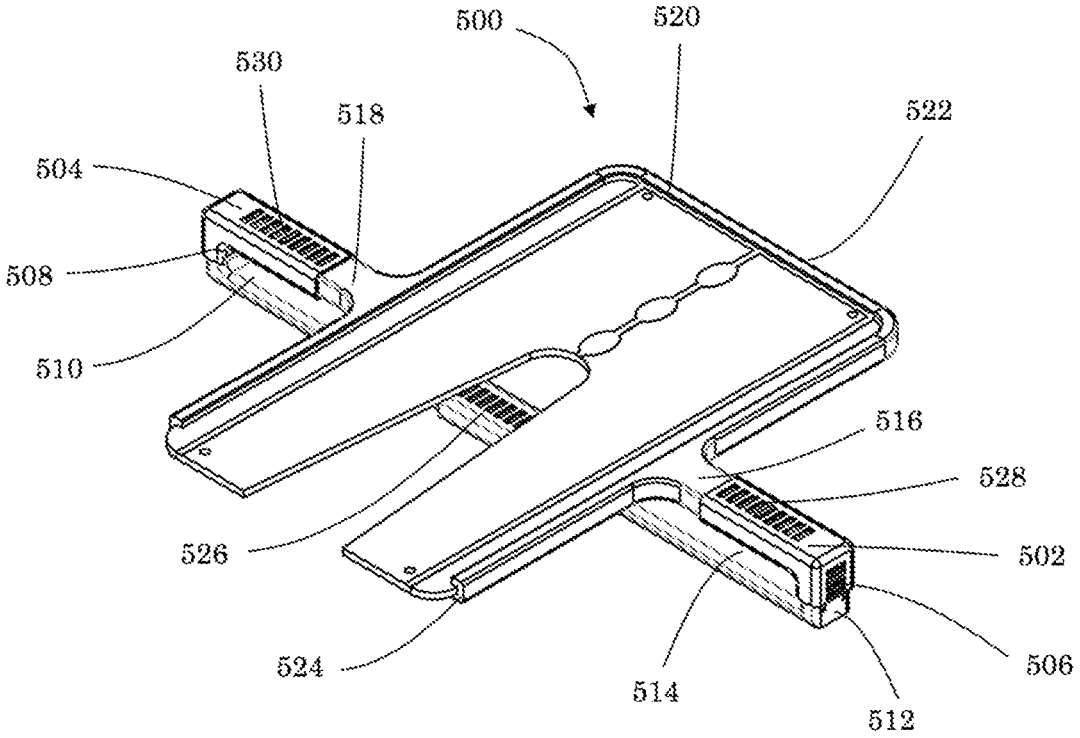
FIG. 9 shows an isometric view of yet another alternative embodiment of a golf putting system omitting a golf mat, wedge, and ball return in accordance to one in accordance to one, or more embodiments.

Referring to FIG. 9 an isometric view of another embodiment of a golf putting system shown generally at 500. In embodiments, a female connection section 502, 504 can have a hollow center to allow a first arm 516 and second arm 518 to slide in and out of. A female connection section 502, 504 can have plurality of slots spaced on its top surface, and in certain embodiments on its bottom surface. A first arm 516 and a second arm 518 can be smaller than the inner dimensions of a female connection sections 502, 504 and can easily slide in and out of a female connection section. A first arm 516 and a second arm 518 can lock into a female connection sections 502, 504 through plurality of slots. A female connection section 502, 504 allows a putting training device holder 520 to adjust to a golf mat's 90 width, so that a user can place and adjust it to various golf mat sizes. In certain embodiments, a first arm 516 and second arm 518 can be substantially rectangular, or in certain embodiments it can be circular, square, triangular, or the like. A female connection section 502, 504 can be a hollowed shape such as, for example, circular, triangular, square. A first arm 516 and a second arm 518 can snap into, connect to, attach to, or the like to a female connection section 502, 504.

In embodiments, a first arm 516 and a second arm 518 can be substantially centered on a putting training device holder 520, or in a preferred embodiment a first arm and a second arm can be offset towards a putting training device's aft end 522, to avoid interfering with a golf ball as it sits within a putting training device. In certain embodiments, a first arm 516 and a second arm 518 can be positioned at the putting training device's aft end 522. The first arm 516, and the second arm 518 can have a prong 528, 530 near its end to lock or snap in a female connection section 502, 504 into position. A first arm 516, and a second arm 518 can have one or more prongs 528, 530 extending perpendicularly from its top surface. The prong 528, 530 can snap into, and can substantially fit into one a plurality of adjustment holes located on the top surface of a female connection section 502, 504 allowing the user to adjust to one or more widths and/or lengths, so that a user can place and adjust to various golf mat sizes. The prong 528, 530 can be rectangular, circular, square, or the like, and can be pressed down into a first arm 516, and a second arm 518 allowing the user to manual adjust the length to fit a golf mats width.

The bottom guide support 514 can be substantially L-shape, and can have a male connection 510, 512 having a length that can extend into a female connection section 502, 504. A male connection 510, 512 can have a prong that extends perpendicularly to its front or back surface, and can be pressed into a male connection's body, and then can be snapped into a female connection section's 502, 504 plurality of holes 506, 510 allowing the user to adjust to one or more heights, so that a user can place the device and adjust to various golf mat thicknesses. A bottom guide support 514 and female connection section 502, 504 can adjust to heights of for example, between 0.0625 inches and 0.750 inches, more preferably a width of between 0.09375 inches and 0.5 inches, and still more preferably a width of approximately 0.375 inches. In embodiments, a bottom guide support 514 can be positioned underneath a putting training device holder 520, and a putting surface (not shown) essentially in a level manner. A bottom guide support 514 can have a male adjustable connection 526 that can slide into and lock into position the female adjustable connection (not shown) allowing a putting training device holder 520, a putting training device, and the bottom guide support 514 to adjust to a thickness of a putting surface (not shown). A bottom guide 514 can have radius outer edges to allow for smooth movement along the bottom surface of a putting surface.

Figure 10:
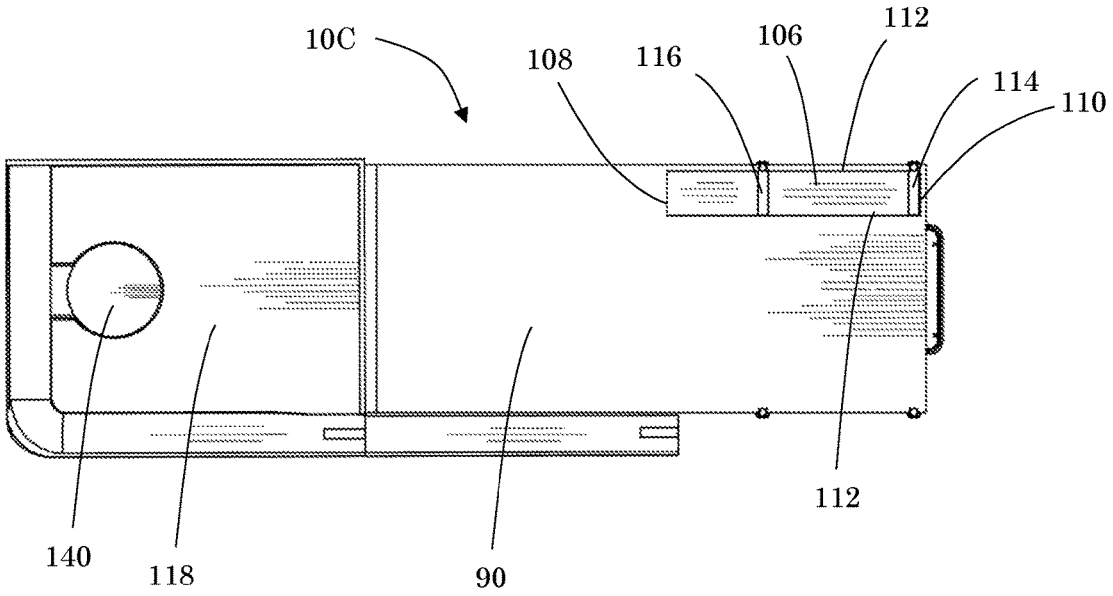
FIG. 10 shows a bottom view with an additional accessory added onto a golf putting system in accordance to one, or more embodiments.
Figure 11:
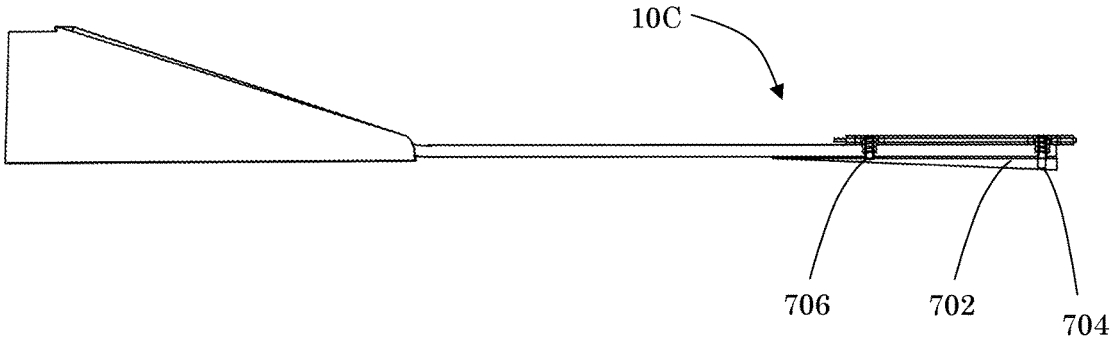
FIG. 11 shows a side view with an additional accessory added onto a golf putting system in accordance to one, or more embodiments.

Referring to FIGS. 10 and 11, a bottom view and a side view of another embodiment of a golf putting system with an accessory is shown generally at 10C. In embodiments, a golf putting system 10C can comprise a platform 12, a holder 40, a golf mat 90, a wedge-shaped incline 118, a golf cup 140, a ball return 160, a ball return extension 170, and mat riser 106. A mat riser 106 can comprise a body having a forward section 108 and aft section 110, a side 112 and an opposing side 114, and can sit substantially flat on its bottom surface. An aft section 110 can gradually slope down to a forward section 108 creating a sloping effect on a golf mat. A mat riser 106 can be rectangular, square, circular, or the like. Putting on a golf green, a golfer can see many different types of slopes, and breaks as the golf ball rolls to a golf cup. A mat riser 106 can give a golfer an option to add a slope or a break to a golf mat simulating the slope or break that they might see on a putting green. A mat riser 106 can slope from one side to an opposing side, or it can have a constant thickness from one side to an opposing side. A mat riser 106 can removably connect to a holder 40 through a forward attachment 116, and an aft attachment 114. A mat riser 106 can removably connected or attached to both sides of a holder 40. A forward attachment 116, and an aft attachment 114 can be a clamp, a pin, a link, a coupler, or the like, and can be removably attached to a putting device holder's 40 hook 80. A mat riser 106 can be made from a lightweight, generally rigid material, such as, for example, plastics including acrylic, acrylonitrile butadiene styrene ("ABS"), polypropylene, polyamide, polyethylene, metals, or the like.

Figure 12:
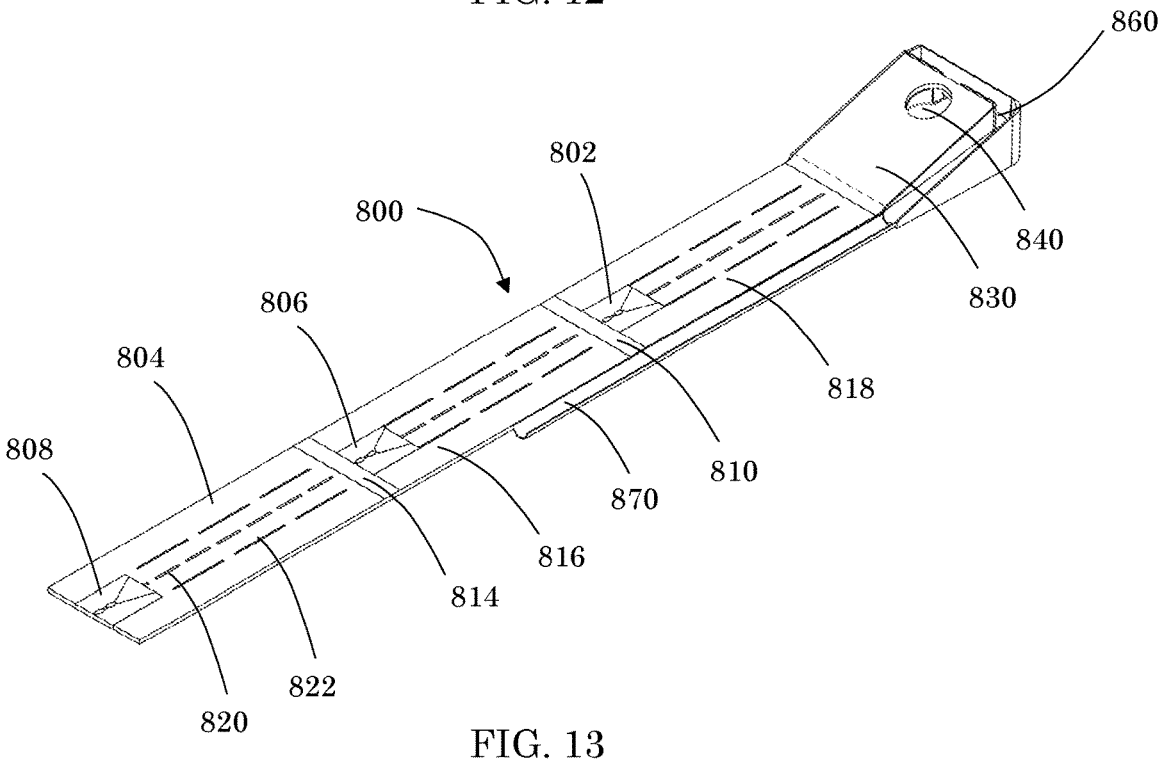
FIG. 12 shows an isometric view of alternative embodiment of a golf putting system in accordance to one in accordance to one, or more embodiments.

Referring to FIG. 12 an isometric view of an alternative embodiment of golf putting system shown generally at 800. A golf putting system 800 can comprise of one or more platforms 802, one or more golf mats 804, 816, and 818, an incline 830, a golf cup 840, a ball return 860, and a ball return extension 870. The golf mat 804, 816, and 818 can comprise a plurality of lines 820 substantially centered on a golf mat. The plurality of lines 820 can be evenly spaced, and positioned substantially centered on each golf mat 804, 816, and 818. A center line 820 can vary in width for example, between 0.0625 inches and 0.250 inches, more preferably a width of between 0.09375 inches and 0.3875 inches, and still more preferably a width of approximately 0.25 inches. A center line 820 can vary in length for example, between 0.25 inches and 6 inches, more preferably a width of between 0.09375 inches and 4 inches, and still more preferably a width of approximately 2 inches. In certain embodiments, a plurality of center lines 820 can be unevenly spaced apart and substantially centered on a golf mat 804, 816, and 818.

In embodiments, a golf mat 804, 816, 818 can have a cutout, a section carved out, a section indented, a groove, or the like for a platform 802, 806, 808 to be inlaid within a golf mat. A platform 802, 806, 808 can sit within a golf mat 804, 816, 818 and can be substantially flat and/or at substantially the same height with a golf mat's top surface which can allow a golf ball to roll over each section without any interference with negligible seams between a putting training device, and golf mat. In certain embodiments, a platform 802, 806, 808 can be inserted into a golf mat 804, 816, 818 through a male and female groove, or a tongue and groove system, which can be on the outer perimeter of the platform, and on the inner perimeter of a golf mat's cutout. In another embodiment, a platform 802, 806, 808 can sit substantially flat and be integrated into a golf mat 804, 816, 818 so that the platform and the golf mat can be one or more pieces. In another embodiment, a platform 802, 806, 808, can be a reflective piece on top of a golf mat 804, 816, 818. The platform 802, 806, 808, can be made of a generally flexible material, and can roll easily roll up or fold up with a putting mat 818 such as, for example, flexible reflective mirror, acrylic mirror, thin sheet of aluminum, crystal clear flexible mirror, reflective mylar, or the like. The platform can be can roll up for easy storage, and shipping, or in certain embodiments it can be solid material, and can easily stack to fit into a shipping container or box.

The golf mat 818, 816, and 804 can comprise of a flap 810, 814 which can be a folding flap, seamless flap, a stitched flap, a Velcro flap, or the like allowing the golf ball to roll over each golf mat section without any obstruction, which can be easily removed from each golf mat section for easy storage, and can allow an adjustable length that a golfer can practice at. The flap 810, 814 can lay substantially within each golf mat 818, 816, and 804 adjoining section, giving each golf mat section a flat, seamless or seamed section that can simulate a real golf green without any interference from each flap. The golf mat 818, 816, and 804 can have numbers substantially along its edges indicating the length from the golf cup, so that a golfer can set a length and can become accustomed to the golf lag at that particular length.

In some embodiments, the golf mat can have a plurality of sight lines 822 positioned apart towards a golf mat's 818, 816, and 804 first side and second side. The plurality of sight lines 822 can be spaced apart substantially the width of a golf ball. The plurality of sight lines 822 can be evenly spaced linearly down a golf mat 818, 816, and 804 or, alternatively, the plurality of sight lines 822 can be unevenly spaced linearly down a golf mat 818, 816, and 804. The plurality of sight lines 822 can vary in width such as, for example, between 0.0625 inches and 2 inches, more preferably a width of between 0.09375 inches and 1 inch, and still more preferably a width of approximately 0.5 inches. A plurality of sight lines 822 can vary in width for example, between 0.0625 inches and 2 inches, more preferably a width of between 0.09375 inches and 1 inch, and still more preferably a width of approximately 0.5 inches apart from each other. A plurality of sight lines 822 can vary in length such as, for example, between 0.0625 inches and 6 inches, more preferably a width of between 0.09375 inches and 4 inch, and still more preferably a width of approximately 2 inches.

In some embodiments, a golfer can add or remove golf mat sections on to the aft end of each golf mat section. A golf mat 818, 816, and 804 can be connected at its aft end to another golf mat either on its bottom surface or on its top surface by such as tongue and slot with grooves configuration, flaps and pins, flaps and snaps, or the like. A golf mat 818, 816, and 804 can be removed from its section and either rolled up, or stacked to allow easy travel and/or storage as shown in FIG. 17. In embodiments, a golf mat 818, 816, and 804 can be for example, between 1 foot and 9 feet, more preferably a width of between 2 foot and 6 feet, and still more preferably a width of approximately 3 feet. As a golfer adds or removes a golf mat 818, 816, and 804 a flap 810, 814 can removably attach each golf mat to and create a smooth and bumpless transition between each golf mat.

Figure 13:
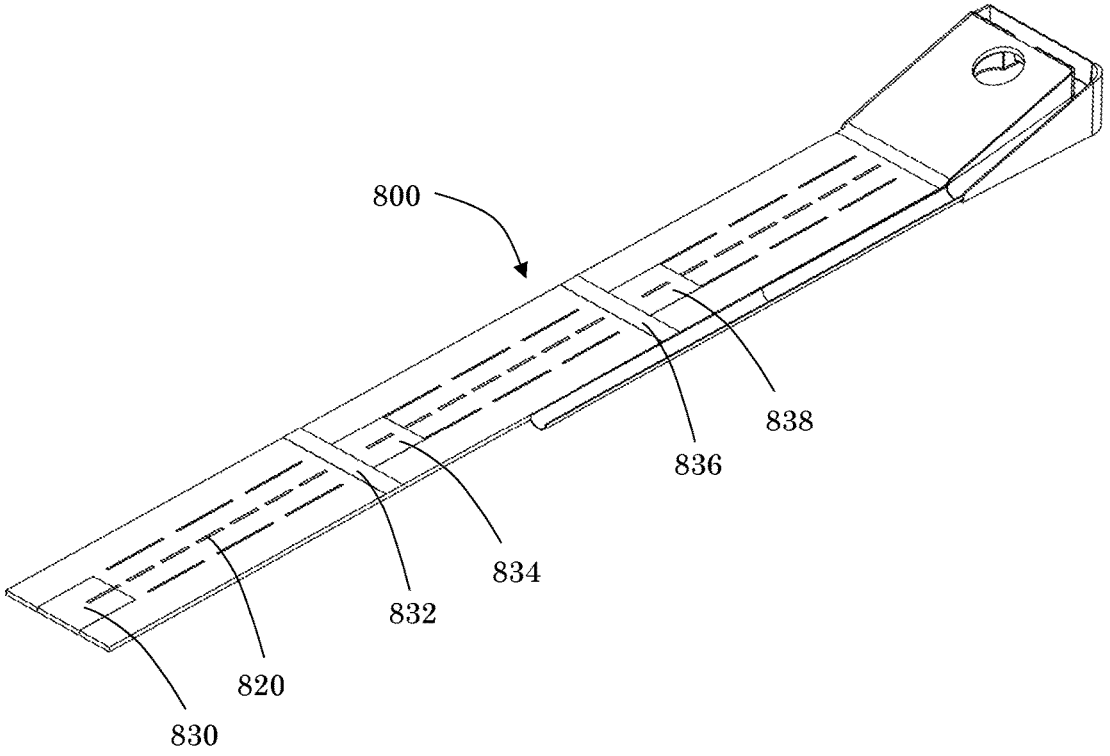
FIG. 13 shows an isometric view of alternative embodiment with an inlay replacing a putting training device of a golf putting system in accordance to one in accordance to one, or more embodiments.

Referring to FIG. 13 as a golfer adds or removes a golf mat onto a golf putting system 800 a golfer can cover or replace a putting training devices 802 with an inlay 830, 834, and 838. An inlay 830, 834, and 838 can be a flap, a cover, a top, a concealer, or the like. An inlay can be removably attached to, removably connected to, or permanently attached to a golf mat 818, 816, and 804. An inlay 830, 834, and 838 can be easily removed, and folded for storage and shipping, or in other embodiments an inlay can be permanently installed in a golf mat 804, 816, 818 and rolled up with the golf mats when shipped or stored. An inlay 830, 834, and 838 can cover a platform 802 or it can replace a putting training device's place within a golf mat 818, 816, and 804. In embodiments, a putting training device can be removed from a golf mat and replaced with an inlay 830, 834, and 838. An inlay 830, 834, and 838 can sit substantially flat with a golf mat 818, 816, and 804, which can allow a golf ball to roll easily over each section without any interference with the following golf mat section. An inlay 830, 834, and 838 can have a center line 820 substantially centered on the inlay. A flap 836, 832 and an inlay can be one piece, or two or more pieces removably attached to each through such as, for example, Velcro, snaps, zippers, tongue and groove, or the like.

In another embodiment, an inlay 830 can slide into and connect to a golf mat 818, 816, and 804 by for example, Velcro, snaps, grooves, grooves with clips, or the like. A platform 802, 806, 808 can have a tongue that can slide into a golf mat's 818, 816, and 804 groove, and snap and/or connect into place in the golf mat. In yet another embodiment, a golf mat 818, 816, and 804 can have a cutout that can be substantially half way through the mat, and a platform 802, 806, 808 can sit at substantially the same height as the top of the golf mat allowing the ball to roll over each section without any obstructions. A platform 802, 806, 808 can be removed from a golf mat, and a inlay 830, 834, and 838 can replace the platform. The platform 802, 806, 808 can sit within a golf mat 804, 816, 818 and can be substantially flat and/or at substantially the same height with a golf mat's top surface which can allow a golf ball to roll over each section without any interference with negligible seams between a putting training device, and golf mat.

Figure 14:
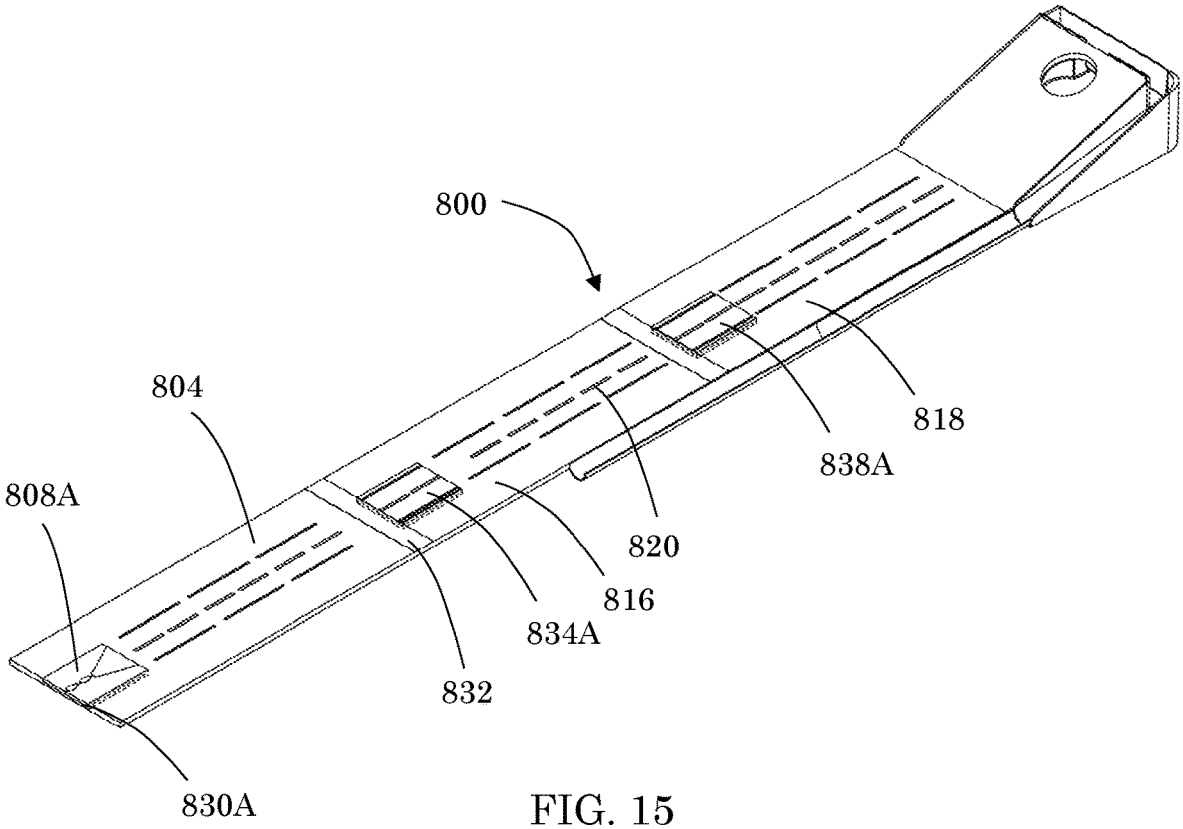
FIG. 14 shows an isometric view of yet another embodiment with a reversible mirror/putting matt of a golf putting system in accordance to one in accordance to one, or more embodiments.
Figure 15:
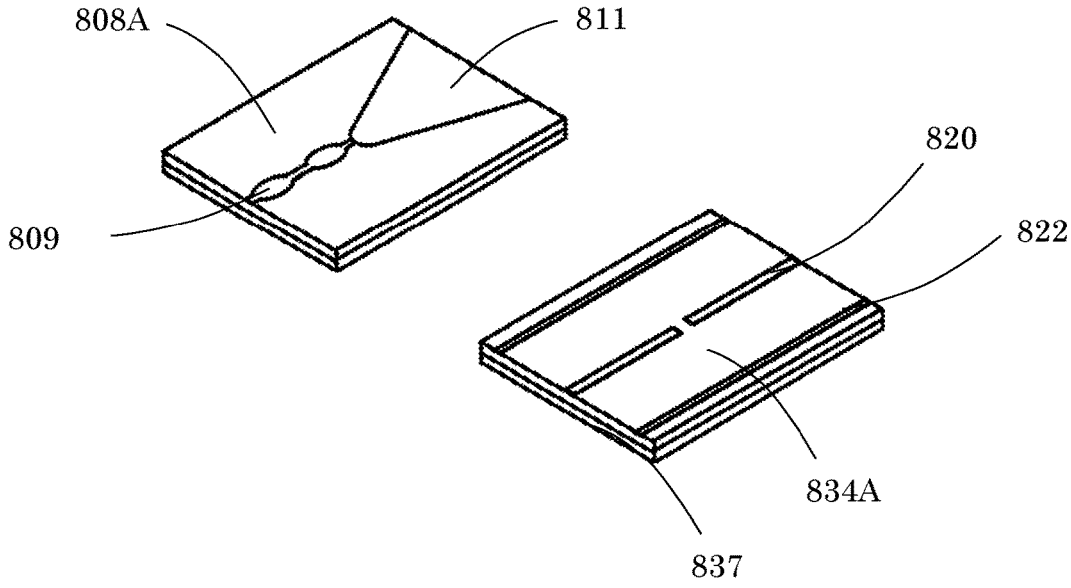
FIG. 15 shows a top and bottom view of another embodiment with a reversible mirror/putting matt with the putting mat, wedge, and ball return being omitted of a golf putting system in accordance to one in accordance to one, or more embodiments.

Referring to FIGS. 14 and 15 an isometric view and a close-up view of inlay, and platform combination of an alternative embodiment of golf putting system shown 800. In embodiments, a inlay 830A, 834A, 838A, and a platform 808A, 806A (not shown), 802A (not shown) can be combined to form one piece having a top and a bottom where a inlay can be the top, and a platform can be the bottom, or when the golfer wants to use the platform, the platform can be the top and the inlay can be the bottom. A platform 808A, 806A (not shown), 802A (not shown) and an inlay 830A, 834A, 838A can be formed as one piece, two pieces, three pieces, four pieces, or the like. In a preferred embodiment, a platform 808A, 806A (not shown), 802A (not shown) and an inlay 830A, 834A, 838A can be formed as two pieces, and then attached together to be substantially the same thickness of a golf mat 818, 816, and 804. A platform 808A, 806A (not shown), 802A (not shown) can be attached to an inlay 830A, 834A, 838A by glue, snaps, Velcro, pegs, welding plastics, or the like. In embodiments, the platform 808A, 806A (not shown), 802A (not shown), can further comprise one or more alignment guides 809 that can be oval or circular in shape, positioned on its tops surface substantially spaced apart from terminus of the cutout towards the proximal end of the platform 808A, 806A (not shown), 802A (not shown), which can be used to correctly position the user's head and body over the golf ball by giving the user a reference to look directly at when about to strike the golf ball. The alignment guides 809, and cutout 811 can be etched, printed, indented, or the like into the surface of the platform 808A, 806A (not shown), 802A (not shown). In embodiments, a user can turn over the platform 808A, 806A (not shown), 802A (not shown) and the inlay 830A, 834A, 838A combination section to show the inlay on top, and the platform on bottom or the platform on top, and the inlay on the bottom. The inlay 830A, 834A, 838A can have one or more sight lines 822, and can comprise a plurality of lines 820 substantially centered on a golf mat.

Figure 16:
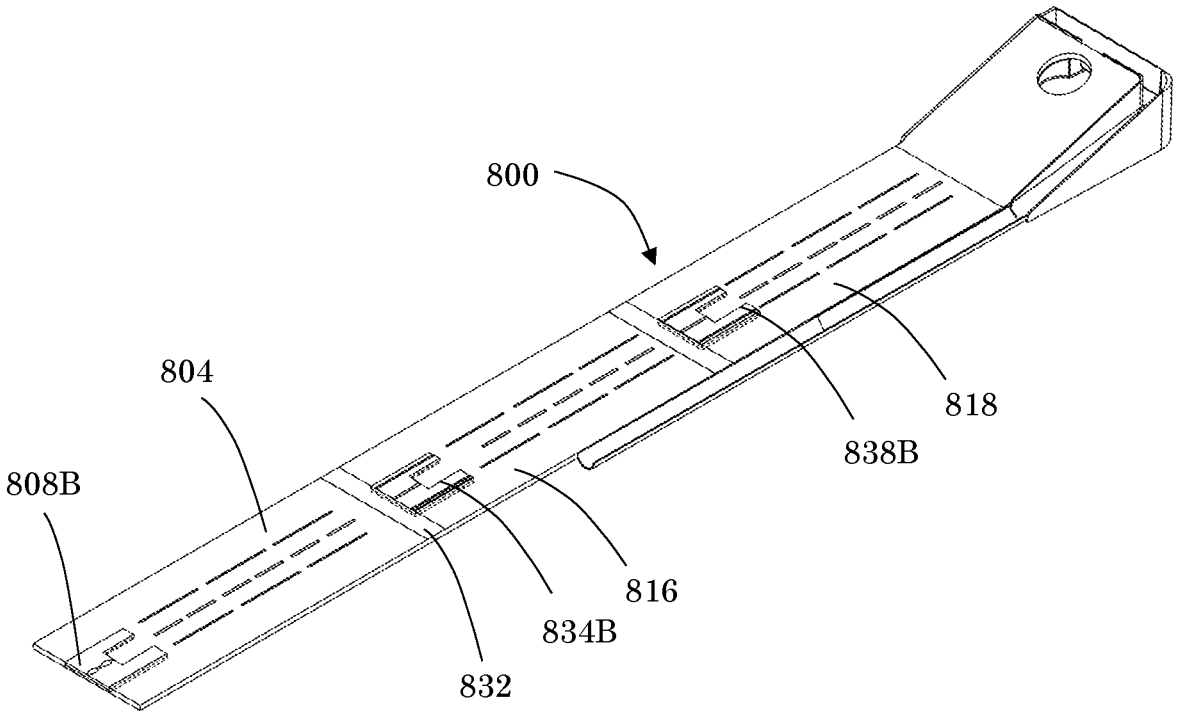
FIG. 16 shows an isometric view of another embodiment with a mirror and putting matt section of a golf putting system in accordance to one in accordance to one, or more embodiments.

Referring to FIG. 16, an isometric view of a platform and inlay combination of yet another embodiment of golf putting system shown 800. In embodiments, a inlay 830B, 834B, 838B, and a platform 808B, 806B (not shown), 802B (not shown) can be combined to form one piece having a top and a bottom where a inlay can be the top, and a platform can be the bottom, or when the golfer wants to use the platform, the platform can be the top and the inlay can be the bottom, and it can be substantially u-shaped, so as not to interfere with a golf ball as it rolls across each golf mat 804, 816, 818 section. The inlay 830B (not shown), 834B, 838B, and the platform 808B, 806B (not shown), 802B (not shown) can be substantially u-shape, v-shape, or the like in shape. The platform 808B, 806B (not shown), 802B (not shown) and an inlay 830B (not shown), 834B, 838B can be formed as one piece, two pieces, three pieces, four pieces, or the like. The inlay 830B (not shown), 834B, 838B, and the platform 808B, 806B (not shown), 802B (not shown) combination can be one piece and substantially the thickness of the golf mat, or it can be two pieces where the golf mat 804, 816, and 818 can have a indent, or cut out that can be about half way through the mat, and can allow the platform, of the inlay to sit substantially the same height, and lay flat with the golf mat. In an another embodiment, a platform 808B, 806B (not shown), 802B (not shown) and an inlay 830B (not shown), 834B, 838B can be formed as two pieces, and then attached together to be substantially the same thickness of a golf mat 818, 816, and 804.

The platform 808B, 806B (not shown), 802B (not shown) can be attached to an inlay 830B, 834B, 838B by glue, snaps, Velcro, pegs, welding plastics, or the like. In embodiments, the platform 808B, 806B (not shown), 802B (not shown), can further comprise one or more alignment guides 809 that can be oval or circular in shape, positioned on its tops surface substantially spaced apart from terminus of the cutout towards the proximal end of the platform 808B, 806B (not shown), 802B (not shown), which can be used to correctly position the user's head and body over the golf ball by giving the user a reference to look directly at when about to strike the golf ball. The alignment guides 809, and cutout 811 can be etched, printed, indented, or the like into the surface of the platform 808B, 806B (not shown), 802B (not shown). In embodiments, a user can turn over the platform 808B, 806B (not shown), 802B (not shown) and the inlay 830B, 834B, 838B combination section to show the inlay on top, and the platform on bottom or the platform on top, and the inlay on the bottom. The inlay 830B, 834B, 838B can have one or more sight lines 822, and can comprise a plurality of lines 820 substantially centered on a golf mat. The inlay 830B (not shown), 834B, 838B, and the platform 808B, 806B (not shown), 802B (not shown) combination can slide into a golf mat 804, 816, and 818 and lock into place by snaps, pegs, locks, or the like.

EXAMPLES

The following non-limiting examples are provided for illustrative purposes only in order to facilitate a more complete understanding of representative embodiments. These examples should not be construed to limit any of the embodiments described in the present specification including those pertaining to a putting training device, and a method of correcting putting.

Example 1

Putting Device System

A golfer looking to improve his/her putting and as a result decrease the number of strokes per hole, he/she will need a system to properly practice, and learn the skills necessary to putt consistently. However, a golfer cannot always be on a putting green on a golf course. A golfer from the comfort to their home can set up a golf putting system within their living room and adjust the golf putting training device to different lengths, and set different slopes to get the golfer different ball trajectory, so that he/she can get the correct lag at different lengths. In addition, the golfer can add or remove golf mats to fit his/her training needs, for example, if the golfer wants to train at 3 feet, 5 feet, or 7 feet, the golfer can add or remove a golf mat section, remove a flap and replace it with a golf training device.

It is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present disclosure, which is defined solely by the claims. Accordingly, embodiments of the present disclosure are not limited to those precisely as shown and described.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

What is claimed is:

1. A golf training system, comprising:

a platform having a proximal end, a distal end and a cutout shape to accommodate a golf ball;

a holder comprising a groove configured to accommodate at least a portion of the perimeter of the platform to selectively secure the platform to the holder;

at least one arm coupled to the holder and extending from the holder to secure the holder to a golf mat;

the at least one arm comprises a first arm extending from a first side of the platform and a second arm extending from an opposing second side of the platform wherein each arm has an extension that extends substantially perpendicular to the arm and is spring biased to engage an edge of the golf mat to secure the holder to the golf mat.

2. The golf training system of claim 1, wherein the arm length is adjustable.

3. The golf training system of claim 1, wherein the at least one arm comprises a height adjustment.

4. The golf training system of claim 1, wherein the at least one arm comprises a hook to secure the holder to the golf mat.

* * * * *